US006935401B2

(12) United States Patent
Fraczek et al.

(10) Patent No.: US 6,935,401 B2
(45) Date of Patent: Aug. 30, 2005

(54) UNIVERSAL BRACKETS FOR ROLLER SHADE

(75) Inventors: Richard Fraczek, Stamford, CT (US); Jo Ann Gardella, Norwalk, CT (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 10/392,021

(22) Filed: Mar. 19, 2003

(65) Prior Publication Data

US 2004/0003904 A1 Jan. 8, 2004

Related U.S. Application Data

(60) Provisional application No. 60/366,322, filed on Mar. 21, 2002.

(51) Int. Cl.[7] ..... A47G 5/02

(52) U.S. Cl. ..... 160/321; 160/323.1; 248/267

(58) Field of Search ..... 160/23.1, 24, 321, 160/323.1, 324, 326; 248/266, 267, 268

(56) References Cited

U.S. PATENT DOCUMENTS

| | | | | |
|---|---|---|---|---|
| 1,476,160 | A | * 12/1923 | Kirsch | 248/267 |
| 1,678,590 | A | * 7/1928 | Dixson | 160/23.1 |
| 2,099,068 | A | * 11/1937 | Keithly | 160/23.1 |
| 3,595,511 | A | * 7/1971 | Summerville, Jr. | 248/264 |
| 3,854,517 | A | * 12/1974 | Nakamura | 160/323.1 |
| 4,167,261 | A | 9/1979 | Bartels | |
| 4,372,432 | A | 2/1983 | Waine et al. | |
| 4,466,475 | A | 8/1984 | Saito et al. | |
| 4,751,953 | A | * 6/1988 | Appel et al. | 160/313 |
| 4,865,109 | A | 9/1989 | Sherman | |
| 5,029,629 | A | * 7/1991 | Cheng-Pei | 160/300 |
| 5,857,653 | A | 1/1999 | Dujlovich | |
| 6,164,428 | A | 12/2000 | Berman et al. | |
| 6,382,296 | B1 | 5/2002 | Judkins | |
| 6,585,208 | B1 | 7/2003 | Fraser | |
| 2003/0015301 | A1 | 1/2003 | Killo | |

* cited by examiner

*Primary Examiner*—Blair M. Johnson
(74) *Attorney, Agent, or Firm*—Jeffrey M. Kaden; Gottlieb, Rackman & Reisman, Esq.

(57) ABSTRACT

Generally speaking, in accordance with the invention, an improved window treatment system is provided. The system includes a head rail, a spring clutch disposed at one end of the head rail and an idler disposed at the other end of the head rail. Significantly, a pair of universal brackets, one coupled to the spring clutch and the other coupled to the idler, are used. Each bracket is suitable for fixedly mounting either the clutch or the idler at either end of the head rail. The brackets are identical.

14 Claims, 4 Drawing Sheets

Fig # 1

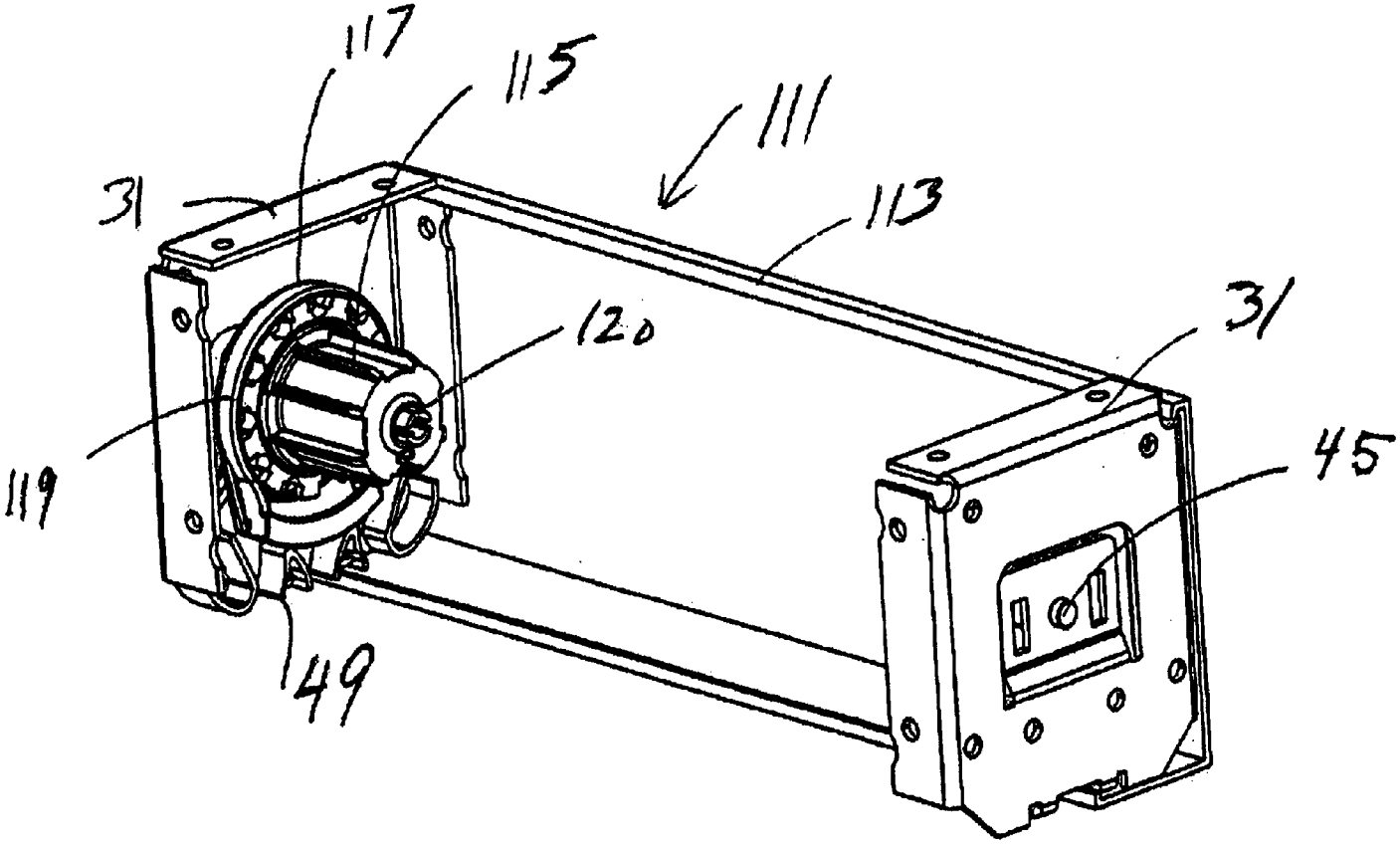
Fig # 4

UNIVERSAL BRACKETS FOR ROLLER SHADE

RELATED APPLICATIONS

This application claims priority to provisional application Ser. No. 60/366,322 filed Mar. 21, 2002 and entitled "Universal Brackets for Roller Shade", incorporated herein by reference.

BACKGROUND OF THE INVENTION

A. Field of Invention

This invention pertains to window treatment systems, and more particularly to a window treatment which utilizes universal brackets for supporting the same on a wall or window frame.

B. Description of the Prior Art

As is well known in the art, a clutch operated window treatment-system or roller shade mechanism must have a bracketing system for supporting the components thereof. Typically, there would be one bracket for supporting the spring clutch and a second different bracket for supporting the corresponding idler. In addition, for each spring clutch and idler having a different size, there would have to be another set of brackets for supporting these elements. Furthermore, if a different shape fascia or head rail was to be used, a new type of bracket would have to be designed. Moreover, the head rail would have to be notched in order to create clearance for the spring clutch, which additionally complicates fabrication.

As a result, different brackets had to be provided for each type of window treatment system. This made the manufacturing process more complicated than otherwise desired. Accordingly, it would be desirable to provide a window treatment or roller shade system which utilized a universal bracketing system for supporting the components thereof.

SUMMARY OF THE INVENTION

Generally speaking, in accordance with the invention, an improved window treatment system is provided. The system includes a head rail, a spring clutch disposed at one end of the head rail and an idler disposed at the other end of the head rail. Significantly, a pair of universal brackets, one coupled to the spring clutch and the other coupled to the idler, are used. Each bracket is suitable for fixedly mounting either the clutch or the idler at either end of the head rail. The two brackets are identical. A mandrel supporting an appropriate window treatment, such as a blind, is disposed between and supported by the idler and the spring clutch.

Each universal bracket includes a first engaging member to enable the spring clutch of the system to be selectively coupled to the bracket as well a second engaging mechanism to enable the idler to be selectively coupled to the bracket. The first engagement means is adapted to support the spring clutch in a fixed position. The second engagement means is adapted to support the idler in a manner that allows the idler to freely rotate with respect to the bracket.

In a preferred embodiment, openings are provided in the bracket that are designed for selectively receiving corresponding fingers disposed along the back of the spring clutch. Further, the bracket includes a third opening that is designed for selectively receiving an extending pin of the idler.

Accordingly, it is an object of the invention to provide an improved window treatment system.

Still another object of the invention is to provide a window treatment that utilizes a universal bracketing system.

Yet a further object of the invention is to provide an improved window treatment system in which a single bracket design is used to support the spring clutch on one side of the head rail and on a idler on the other side of the head rail.

Still other objects and advantages of the invention will in part be obvious and will in part be apparent from the following description.

The invention comprises the features of construction and combination of elements described in the following description, and the scope of the invention will be identified in the claims.

BRIEF DESCRIPTION OF THE DRAWINGS

For a fuller understanding of the inventions, reference is made to the following description taken in connection with the accompanying drawings, in which:

FIG. 4. is a front perspective view of a second embodiment of the inventive treatment window system.

DETAILED DESCRIPTION OF THE PREFERRED EMBODIMENTS

Figure 1:
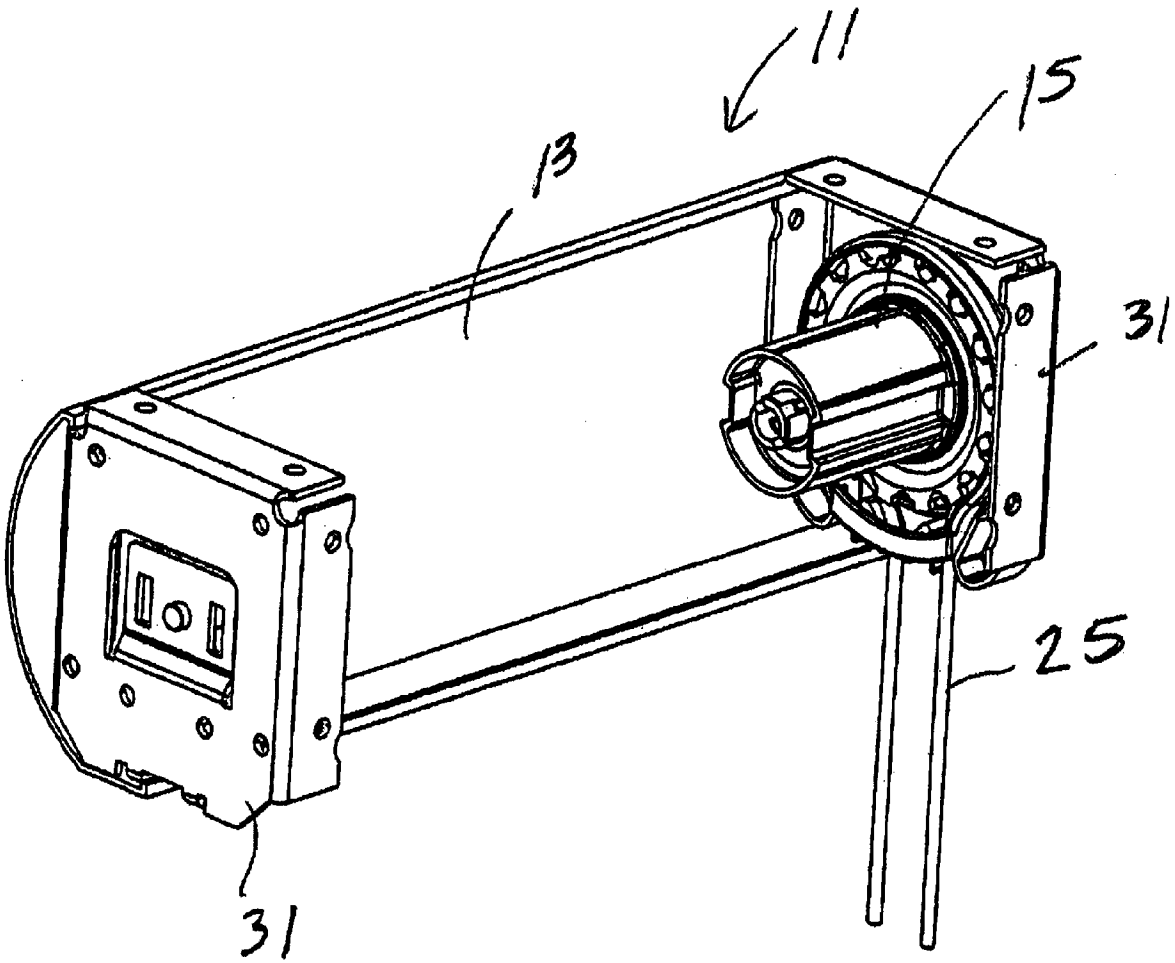
FIG. 1. is a back perspective view of the window treatment system of the invention.
Figure 2:
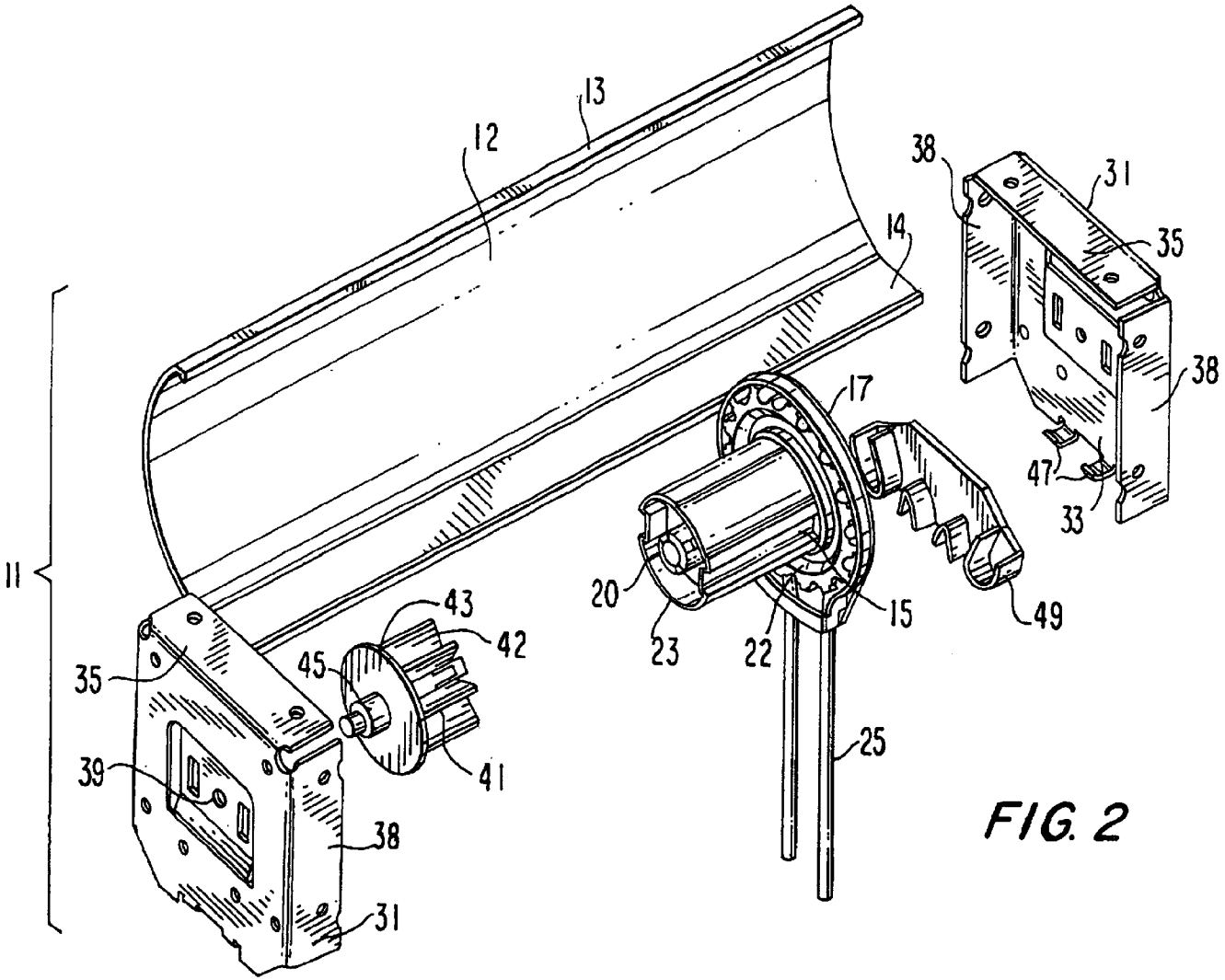
FIG. 2. is an exploded back perspective view of the window treatment.
Figure 3:
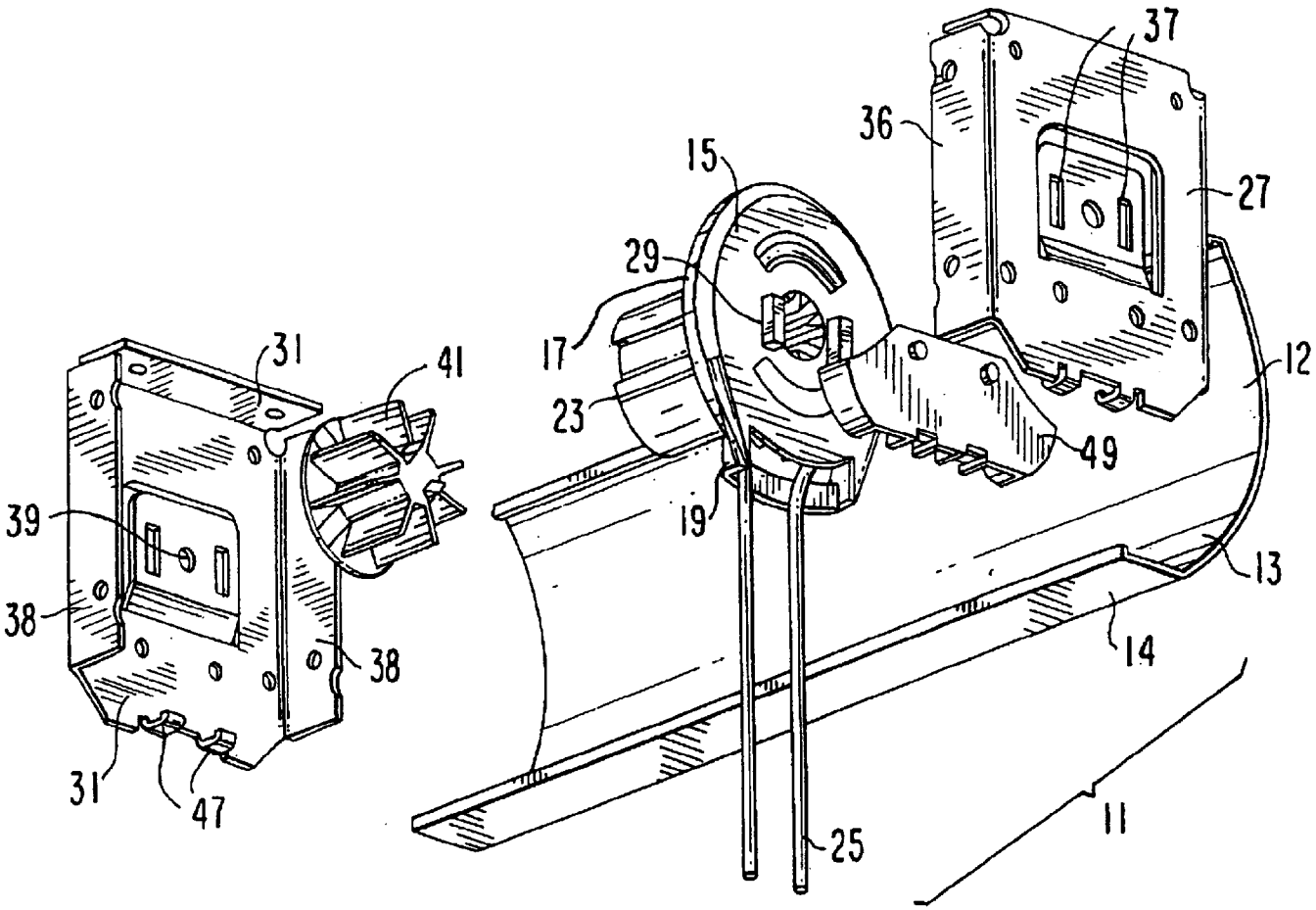
FIG. 3. is an exploded back perspective view of the window treatment system of the invention.

Referring first to FIG. 1–3, a window treatment or roller shade system generally indicated as 11 and constructed in accordance with the invention is shown. System 11 includes a head rail 13, a spring clutch 15, a cord (or bead chain) 25, a facing spring-loaded idler 41, a cord router 49, and a pair of facing universal brackets 31. As shown, in FIG. 1 brackets 31 are mounted along the ends of head rail 13. Head rail 13 includes an elongated curved portion 12 and an integrally formed elongated flat 14. Spring clutch 15 and idler 41 cooperate to support therebetween the mandrel with an appropriate blind or other window treatment. The mandrel has been omitted for the sake of clarity. Pulling on cord 25 in either direction forces the mandrel to rotate as well, thereby raising or lowering the respective blind or window treatment.

Spring clutch 15 has two parts, a fixed housing element 17 and a rotating sleeve 23. Fixed housing element 17 is generally comprised of a shroud portion 19 and an extension 20. A pulley 22 is rotatably mounted on the extension 20. A cord 25 is trained about the outer circumference of pulley 22. Shroud 19 is constructed and arranged to keep cord 25 in engagement with pulley 22 and to act as a cover and guide for cord 25. Pulley 22 and the spring clutch 15 are arranged and constructed to cause the spring clutch 15 to rotate when the pulley is turned by cord 25 in a well-known manner.

Sleeve 23 includes a spring (not shown) having an inside diameter that is slightly smaller than the outside diameter of extension 20. When fixed housing element 17 and rotating sleeve 23 are assembled, the spring must be slightly expanded to fit over extension 20. The fixed and rotating elements thus form a wrap spring that is configured to slip in one direction almost without resistance, and provide moderate resistant to slippage in the other direction, as is well known.

Housing element 17 engages back portion 27 of universal bracket 31, as shown in FIG 3. Spring clutch 15 is formed with a pair of depending fingers 29. These fingers 29 pass through corresponding openings 37 in back portion 27 of universal bracket 31.

Each of the universal brackets 31 made in accordance with the invention include a body 33 including two parallel slots 37, a top wall 35 and pair of side walls 38, as shown in FIG. 1. Top wall 35 and one of side wall 37 are used for selectively mounting bracket 31 at either end of head rail of 13. The other side wall 38 is in turn mounted on wall or window frame (not shown). Spring clutch 15 and shroud 19 of housing element 17, is attached to bracket 31 by pushing fingers 29 disposed along back portion 27 through slots 37. Fingers 29 are shaped so that they can be placed into the opening to rest or be suspended on body 33 of bracket 31.

Idler 41 faces or opposes spring clutch 15 and is disposed at the opposite end of head rail 13. Idler 41 includes a plurality of fins 42 and a plate 43 with a dependent pin 45. Pin 45 is coaxially positioned with respect to spring clutch 15 and extension 20.

A second bracket 31 is secured to the opposite end of head rail 13. The two brackets 31 are identical. Therefore, each bracket 31 has a pair of slots 37 as previously described and each bracket 31 also has a hole 39 formed in body 33, and positioned preferably centrally of the pair of slots. Bracket 31 as shown in FIG. 1. Hole 39 is shaped and sized to receive pin 45 of idler 41. When idler 41 is in place, pin 45 is freely rotatable with respect to its bracket 31.

As best shown in FIGS. 2 and 3, the bottom of body 33 of each of universal brackets 31 is formed with a pair of underlying hooks 47, which, as described, provide a dual function. Hooks 47 are used to support a cord router 49, which is placed along and underneath clutch 15 of system 11, as well as to engage flat 14 of head rail 13.

FIG. 4 shows another embodiment of the invention. In this embodiment, a window treatment system 111 also utilizes two universal brackets 31. System 111 includes an L-shaped head rail 113, a spring clutch 115 of a somewhat smaller size than clutch 15, a housing element 117, a facing spring-loaded idler (not visible, except for its pin 45), and a cord router 49. Housing element 117 includes a shroud 119 and an extension 120.

As in the earlier embodiment, each bracket 31 is mounted at either end of head rail 113 and supports rail 113 by means of underlying hooks (see FIG. 4). Moreover, one bracket 31 is coupled to the clutch 115 by means of a finger slot engagement, while the other bracket is coupled to idler 41 by means of a pin and hole arrangement in both the same manner as described for the embodiment of FIGS. 1–3.

It will thus be seen that the objects set forth above, among those made apparent from the description, are efficiently obtained, and certain changes may be made in the construction of the inventive system without departing from the spirit and scope of the invention, it is intended that all matter contained in the above description and shown in the accompanying drawings shall be interpreted as illustrative and not in limiting sense.

It is also to be understood that the following claims are intended to cover all of the generic and specific features of the invention herein described and all statements of the scope of the invention which, as a matter of language, might be said to fall therebetween.

We claim:

1. A window treatment system comprising:

a head rail, a spring clutch disposed at one end of said head rail, an idler disposed at the other end of said head rail, and pair of universal brackets, mounted at said ends, each bracket having a first engagement member arranged and constructed to couple to said clutch and a second engagement member arranged and constructed to couple to said idler;

wherein said brackets are identical with one bracket being selectively coupled to suad spring clutch by its first engagement member and the second bracket being selectively coupled to said idler by said second engagement member.

2. The system claim 1, wherein said first engaging member includes at least one slot for selectively receiving at least one finger depending from said clutch.

3. The system claim 2, wherein said second engaging member comprises at least one opening for selectively receiving at least one pin depending from said idler.

4. The system of claim 3, wherein said clutch includes at least a fixed portion and a moving portion, said finger being dependent on said fixed portion.

5. The system of claim 3, wherein said pin is rotatable with respect to the respective bracket.

6. The system of claim 1, wherein each of said brackets also includes a supporting member to support said head rail.

7. The system of claim 6, wherein said supporting member comprises at least one hook member on which a portion of said head rail is supported.

8. The system of claim 4, further including at least a cord router disposed underneath said clutch and supported by said at least one hook member.

9. A window treatment system comprising: a head rail with a first and a second end; a spring clutch disposed at said first end; an idler attached disposed at said second end; a first and a second bracket, said brackets including a first engagement member for engaging said spring clutch and a second engagement member for engaging said idler, said first bracket fixedly supporting said clutch with said first engagement member; and said second bracket rotatably supporting said idler with said second engagement member; wherein said first and second brackets are identical.

10. The window treatment system of claim 9, further comprising a fixed housing disposed at said first end, said fixed housing including a shroud and a back portion.

11. The window treatment system of claim 10, wherein said clutch includes a pair of fingers extending through said back portion.

12. The window treatment system of claim 11, wherein each said bracket includes a set of slots adapted to receive and form an interference fit with said fingers.

13. The window treatment system of claim 12, wherein said idler includes a pin and said brackets include a hole adapted to rotatably receive said pin.

14. The window treatment system of claim 13, wherein said hole is disposed between said slots.

* * * * *